US010096286B2

(12) United States Patent
Cho et al.

(10) Patent No.: US 10,096,286 B2
(45) Date of Patent: Oct. 9, 2018

(54) SCAN DRIVER AND ORGANIC LIGHT EMITTING DISPLAY DEVICE HAVING THE SAME

(71) Applicant: Samsung Display Co., Ltd., Yongin-si, Gyeonggi-do (KR)

(72) Inventors: Geun-Ho Cho, Hwaseong-si (KR); Yong-Sung Park, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 23 days.

(21) Appl. No.: 15/369,321

(22) Filed: Dec. 5, 2016

(65) Prior Publication Data

US 2017/0206840 A1 Jul. 20, 2017

(30) Foreign Application Priority Data

Jan. 19, 2016 (KR) ..... 10-2016-0006284

(51) Int. Cl.
*G09G 3/3266* (2016.01)
*G09G 3/3233* (2016.01)
*G09G 3/3291* (2016.01)

(52) U.S. Cl.
CPC ..... *G09G 3/3266* (2013.01); *G09G 3/3233* (2013.01); *G09G 3/3291* (2013.01); *G09G 2300/0842* (2013.01); *G09G 2310/0251* (2013.01); *G09G 2310/0286* (2013.01); *G09G 2310/067* (2013.01); *G09G 2310/08* (2013.01); *G09G 2320/0233* (2013.01); *G09G 2320/0295* (2013.01)

(58) Field of Classification Search
CPC ..... G09G 2310/0286; G09G 2300/043; G09G 2320/045; G09G 2320/046; G09G 2300/0819
See application file for complete search history.

(56) References Cited

U.S. PATENT DOCUMENTS

2009/0303169 A1* 12/2009 Tanikame ..... G09G 3/3266 345/100
2011/0057919 A1 3/2011 Kim et al.
2011/0193855 A1* 8/2011 Han ..... G09G 3/3233 345/214
2012/0019569 A1 1/2012 Byun
2016/0217728 A1* 7/2016 In ..... G09G 3/3275
2017/0092199 A1* 3/2017 Park ..... G09G 3/3258

* cited by examiner

*Primary Examiner* — Sepehr Azari
(74) *Attorney, Agent, or Firm* — Lewis Roca Rothgerber Christie LLP

(57) ABSTRACT

A scan driver includes a plurality of stages for respectively outputting a plurality of scan signals, an N-th stage of the stages including a shift register for outputting an N-th carry signal based on a frame start signal or based on a carry signal from a previous stage, and an output control block for outputting the N-th carry signal as an N-th scan signal in a display mode, and for repeatedly outputting active periods of the N-th scan signal during an active period of the N-th carry signal in a sensing mode, wherein N is a positive integer.

20 Claims, 16 Drawing Sheets

SCAN DRIVER AND ORGANIC LIGHT EMITTING DISPLAY DEVICE HAVING THE SAME

CROSS-REFERENCE TO RELATED APPLICATION

This application claims priority to, and the benefit of, Korean Patent Application No. 10-2016-0006284, filed on Jan. 19, 2016, in the Korean Intellectual Property Office, the disclosure of which is incorporated herein in its entirety by reference.

BACKGROUND

1. Field

Embodiments of the inventive concept relate to organic light emitting display devices, and to a scan driver included in the same.

2. Discussion of Related Art

An organic light emitting display device may display images using organic light emitting diodes. Luminance variations and image blurring may be noticeable because degradation of the organic light emitting diodes, and a difference in the threshold voltage/mobility of a driving transistor, may occur. Thus, data voltage compensations may be performed to improve display quality. For example, an external compensation technique analyzes a sensing current generated in a pixel, and compensates the data voltage (or compensates the degradation) using a sensing circuit, which may arranged outside the pixels or the display panel.

A scan driver (in conjunction with a sensing driver for applying sensing signals to pixels) may sequentially provide a plurality of scan signals with respect to pixel rows to display images, and to detect or sense pixel characteristics, or the characteristics of the driving transistor. The scan driver may adjust duration of an active period of the scan signal by adjusting an active period of a clock signal or a frame start signal. However, the scan driver may provide single active periods of each scan signal to each scan line for sensing the pixel characteristics in the sensing mode.

SUMMARY

Embodiments may provide a scan driver including an output control block for performing a multi sensing operation.

Embodiments may provide an organic light emitting display device having the scan driver.

According to an embodiment of the present invention, a scan driver includes a plurality of stages for respectively outputting a plurality of scan signals, an N-th stage of the stages including a shift register for outputting an N-th carry signal based on a frame start signal or based on a carry signal from a previous stage, and an output control block for outputting the N-th carry signal as an N-th scan signal in a display mode, and for repeatedly outputting active periods of the N-th scan signal during an active period of the N-th carry signal in a sensing mode, wherein N is a positive integer.

The output control block may be for receiving a sensing clock signal and for determining a number of active periods of the N-th scan signal in the sensing mode based on an active period of the sensing clock signal and based on the active period of the N-th carry signal.

A duration of the active period of the N-th scan signal may be substantially the same as a duration of the active period of the sensing clock signal.

The output control block may be for generating the active period of the N-th scan signal that is synchronized with the active period of the sensing clock signal during the sensing mode.

The output control block may include a first switch for transmitting the sensing clock signal based on the N-th carry signal, and including a gate electrode connected to a first node to receive the N-th carry signal, a second switch connected between the first switch and an output terminal, and including a gate electrode for receiving a first sensing control signal, and a third switch connected between the first node and the output terminal, and including a gate electrode for receiving a second sensing control signal.

The first sensing control signal may have an inactive level during the display mode, and the second sensing control signal may have an active level during the display mode.

The first sensing control signal may have an active level during the sensing mode, and the second sensing control signal may have an inactive level during the sensing mode.

The output control block may include a first switch for transmitting the sensing clock signal based on the N-th carry signal, and including a gate electrode for receiving the N-th carry signal, a second switch connected between the first switch and an output terminal, and including a gate electrode for receiving a first sensing control signal, a third switch connected between the output terminal and a first node where the N-th carry signal is output, and including a gate electrode for receiving a second sensing control signal, and a fourth switch connected between the first node and the gate electrode of the first switch, and including a gate electrode for receiving the first sensing control signal.

The first sensing control signal may have an inactive level during the display mode, and the second sensing control signal may have an active level during the display mode.

The first sensing control signal may have an active level during the sensing mode, and the second sensing control signal may have an inactive level during the sensing mode.

According to an embodiment of the present invention, an organic light emitting display device includes a display panel including a plurality of pixels to be driven by a display mode and by a sensing mode, a data driver for providing a data voltage corresponding to a display image to the display panel in the display mode, and for providing a sensing voltage to the display panel based on a data control signal in the sensing mode, a scan driver for repeatedly generating and applying an active period of a scan signal to a scan line in the sensing mode, a sensing driver for repeatedly generating and applying an active period of a sensing signal to a sensing line corresponding to the scan line in the sensing mode, and a controller for performing a compensation with respect to the pixels based on sensing currents that are repeatedly generated at the pixels corresponding to the scan line in the sensing mode.

The controller may be for calculating a compensation value of image data based on at least one of an average of the sensing currents, a maximum value of the sensing currents, and a minimum value of the sensing currents in the sensing mode.

The scan driver may include a plurality of stages for respectively outputting a plurality of scan signals, an N-th stage of the stages including a shift register for outputting an N-th carry signal based on a frame start signal or based on a carry signal from a previous stage, and an output control block for outputting the N-th carry signal as an N-th scan signal in the display mode, and for repeatedly outputting active periods of the N-th scan signal during an active period of the N-th carry signal in the sensing mode, where N may be a positive integer.

The output control block may be for receiving a sensing clock signal during the sensing mode, and may be for determining a number of active periods of the N-th scan signal in the sensing mode based on an active period of the sensing clock signal and based the active period of the N-th carry signal.

A duration of the active period of the N-th scan signal may be substantially the same as a duration of the active period of the sensing clock signal.

The output control block may include a first switch for transmitting the sensing clock signal based on the N-th carry signal, and including a gate electrode connected to a first node for receiving the N-th carry signal, a second switch connected between the first switch and an output terminal, and including a gate electrode for receiving a first sensing control signal, and a third switch connected between the first node and the output terminal, and including a gate electrode for receiving a second sensing control signal.

The sensing driver may include a plurality of stages for respectively outputting a plurality of sensing signals, an N-th stage of the stages including a shift register for outputting an N-th carry signal based on a frame start signal or based on a carry signal from a previous stage, and an output control block for outputting the N-th carry signal as an N-th sensing signal in the display mode, and for repeatedly outputting active periods of the N-th sensing signal during an active period of the N-th carry signal in the sensing mode, N being a positive integer.

According to another embodiment of the present invention, a scan driver includes a plurality of stages for respectively outputting a plurality of scan signals, an N-th stage of the stages including, a shift register for outputting an N-th carry signal based on a frame start signal or based on a carry signal from a previous stage, an output control block for outputting the N-th carry signal as an N-th scan signal in a display mode, and for repeatedly outputting active periods of the N-th scan signal during an active period of the N-th carry signal in a sensing mode, and a buffer block for controlling a rising time and a falling time of the N-th scan signal output from the output control block, N being a positive integer.

The output control block may be for receiving a sensing clock signal during the sensing mode, and may be for determining a number of active periods of the N-th scan signal in the sensing mode based on an active period of the sensing clock signal and based on the active period of the N-th carry signal.

The buffer block may include a plurality of complementary metal oxide semiconductor (CMOS) transistors connected in series to each other.

Therefore, the scan driver according to example embodiments may include the output control block implemented by the simple circuit such that wave forms of the scan signal may be different according to the display mode and the sensing mode. Thus, a multi-sensing (or detecting) operation can be performed at each pixel row during the sensing mode such that the detection accuracy of pixel characteristics may be improved. Further, the circuit of the output control block for the pixel sensing may be separated from the shift register such that malfunctions of the scan driver may be detected.

In addition, the organic light emitting display device may perform the multi-sensing at each pixel row corresponding to each of the scan lines in the sensing mode. The organic light emitting display device may also calculate more accurate sensing values or compensation values based on statistics of the multi-sensing results. Thus, accuracy of compensation of pixel characteristics and degradations may be improved and the image quality of the organic light emitting display device may be improved.

BRIEF DESCRIPTION OF THE DRAWINGS

These and/or other aspects will become apparent and more readily appreciated from the following description of the embodiments, taken in conjunction with the accompanying drawings, in which.

DETAILED DESCRIPTION

Figure 1:
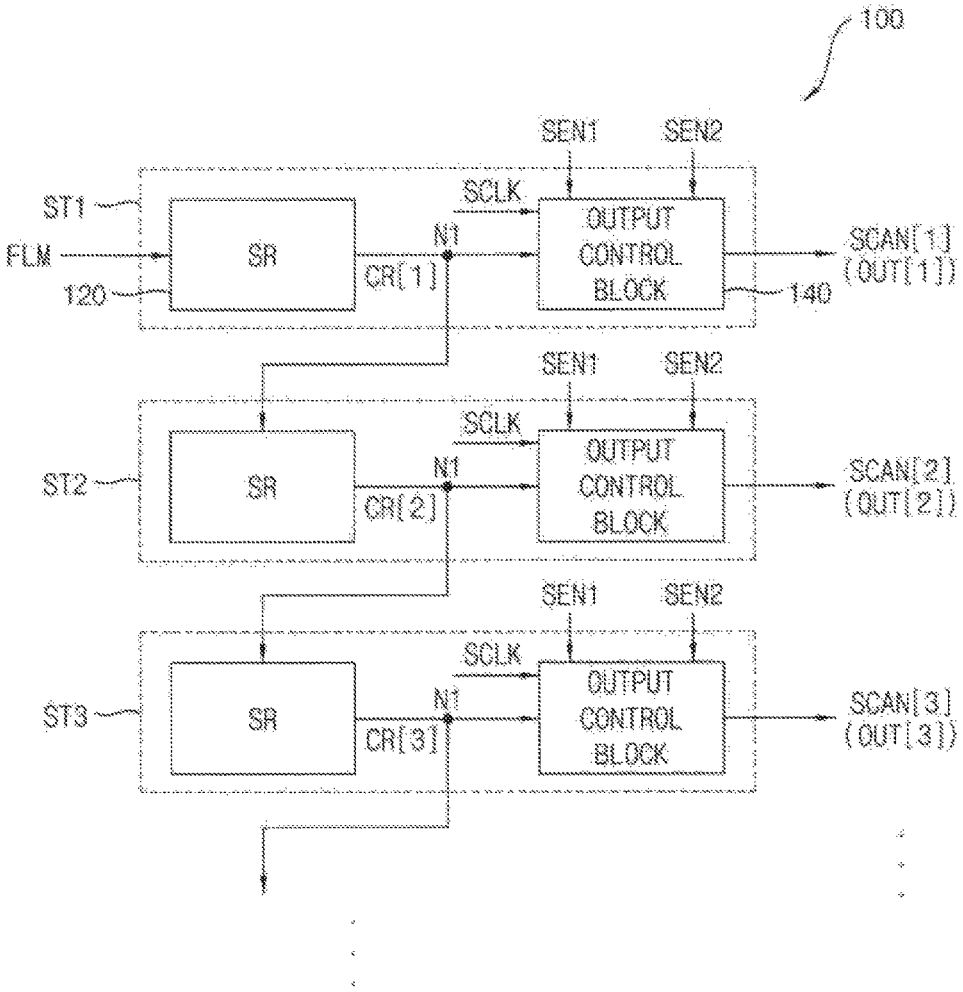
FIG. 1 is a block diagram of a scan driver according to an embodiment.

Features of the inventive concept and methods of accomplishing the same may be understood more readily by reference to the following detailed description of embodiments and the accompanying drawings. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
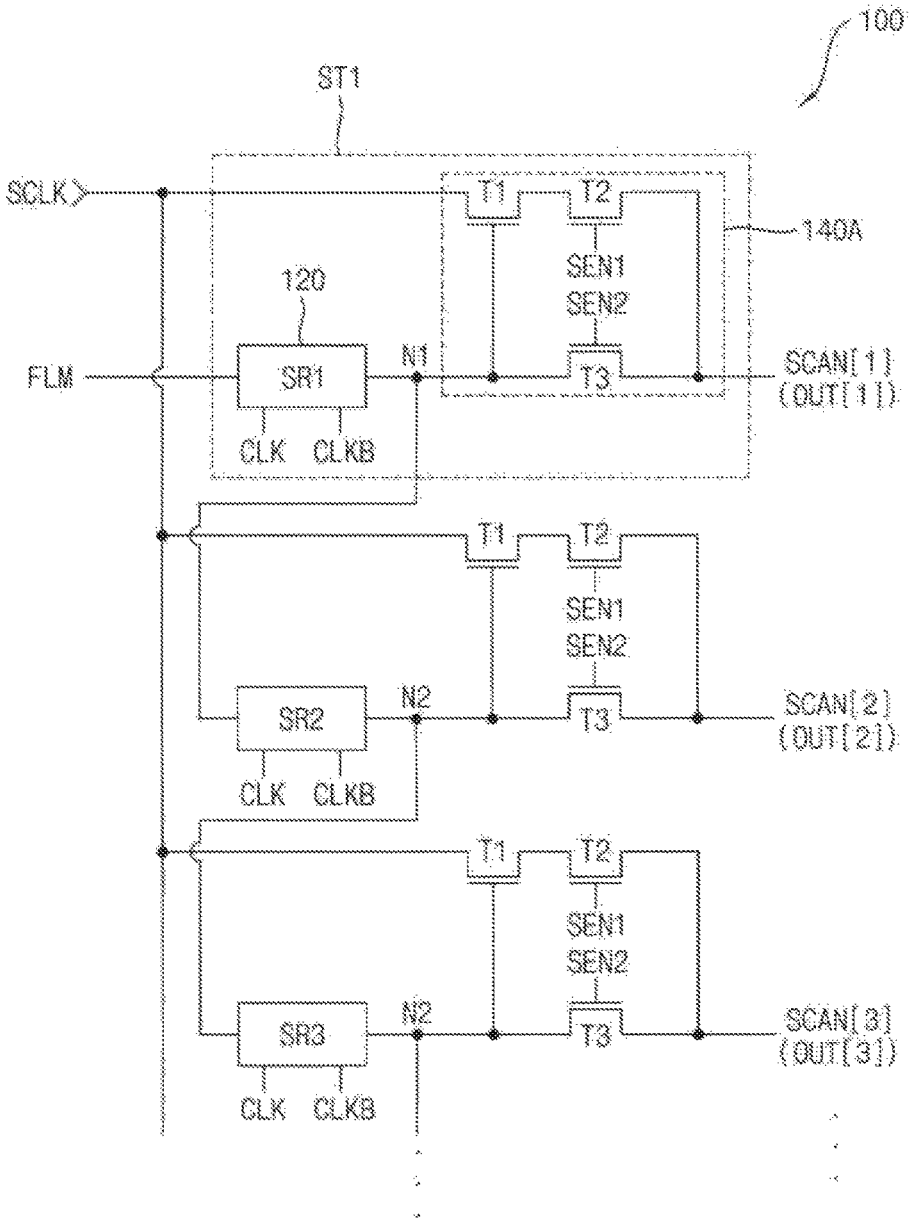
FIG. 2 is a diagram illustrating an embodiment of the scan driver of FIG. 1.

FIG. 1 is a block diagram of a scan driver according to an embodiment, and FIG. 2 is a diagram illustrating an embodiment of the scan driver of FIG. 1.

Referring to FIGS. 1 and 2, the scan driver 100 may include a plurality of stages ST1, ST2, ST3, etc. connected to each other.

The stages ST1, ST2, ST3, etc. may be respectively connected to a corresponding one of scan lines. For example, the stages ST1, ST2, ST3, etc. may output a plurality of scan signals SCAN[1], SCAN[2], SCAN[3], etc. via the scan lines, respectively; however, this is an example, and the signals output from the stages ST1, ST2, ST3, etc. are not limited thereto. As another example, each of the signals output from the stages ST1, ST2, ST3, etc. may be emission control signals, sensing signals, initialization signals, etc., according to constructions of transistors in a pixel.

The scan driver 100 may output the scan signals having different waveforms in accordance with a display mode and a sensing mode. In the display mode, the scan driver 100 may sequentially output the scan signals to display an image. In the sensing mode, the scan driver 100 may repeatedly output the scan signal of each scan line to detect degrees of degradation of the pixels.

Each of the stages ST1, ST2, ST3, etc. may include a shift register (SR) 120 and an output control block 140. The shift registers 120 may be connected to each other. The shift registers 120 may generate carry signals CR[1], CR[2], CR[3], etc., based on a frame start signal FLM or based on the carry signal output from a previous stage.

Hereinafter, it may be described with reference to the shift register 120 and the output control block 140 included in a first stage ST1. Constructions and operations of other stages ST2, ST3, etc. may be substantially the same as the first stage ST1.

The shift register 120 of the first stage ST1 may receive the frame start signal FLM, clock signals CLK and CLKB (see FIG. 2), and control signals, and may output a first carry signal CR[1] to the output control block 140 and to the shift register 120 of a next stage (e.g., the second stage ST2). In an embodiment, the shift register 120 may include a driving block driven by an input signal (e.g., the frame start signal FLM or the previous stage carry signal) and the clock signals CLK and CLKB, and may include a buffer block configured to pull up and pull down an output of the driving block to output the first carry signal CR[1]. An active period (or duration) of the first carry signal CR[1] may be controlled by an active period of the frame start signal FLM and/or the clock signal CLK and CLKB. For example, the active period of the first carry signal CR[1] may correspond to the active period of the frame start signal FLM, or may correspond to the active period of the clock signals CLK and CLKB. The shift register 120 may be implemented by various suitable circuits using the input signal and a plurality of clock signals CLK and CLKB.

The output control block 140 may receive the first carry signal CR[1] from the shift register 120, and may output a first scan signal SCAN[1] to an output terminal OUT[1] based on the first carry signal CR[1].

The output control block 140 may transmit the first carry signal CR[1] to the output terminal OUT[1] in the display mode. Thus, the first carry signal CR[1] may be the same as the first scan signal SCAN[1].

The output control block 140 may repeatedly generate and output an active period of the first scan signal SCAN[1] during the active period of the first carry signal CR[1] in the sensing mode. For example, a plurality of active periods of the first scan signal SCAN[1] may be generated during the single active period of the first carry signal CR[1] in the sensing mode. The output control block 140 may receive a sensing clock signal SCLK, and may determine the number of the active periods of the first scan signal SCAN[1] based on an active period of the sensing clock signal SCLK and based on the active period of the first carry signal CR[1] during the sensing mode. The sensing clock signal SCLK may be applied to the output control blocks of all of the stages ST1, ST2, ST3, etc. in common.

In an embodiment, the duration of the active period of the first scan signal SCAN[1] may be substantially the same as a duration of the active period of the sensing clock signal SCLK. The output control block 140 may generate the active period of the first scan signal SCAN[1] that is synchronized with the active period of the sensing clock signal SCLK during the sensing mode. In an embodiment, the number of the active periods of the first scan signal SCAN[1] may correspond to the number of active periods of the sensing clock signal SCLK within the active period P2 (e.g., see FIG. 4) of the first carry signal CR[1]. For example, when the duration of the active period of the first carry signal CR[1] increases, the number of the active periods of the sensing clock signal SCLK within the first carry signal CR[1] and the number of the active periods of the first scan signal SCAN[1] may also increase. Thus, a sensing current detecting operation to pixel rows (e.g., a first pixel row corresponding to the first scan signal SCAN[1]) may be repeated in the sensing mode.

When the duration of the active period of the sensing clock signal SCLK increases, the duration of the active periods of the first scan signal SCAN[1] may also increase. Accordingly, the output control block 140 may output the plurality of active periods of the first scan signal SCAN[1] during the active period of the first carry signal CR[1]. Further, the duration of the active period of the sensing clock signal SCLK and/or the duration of the active period of the first carry signal CR[1] may be adjusted such that the number of times being detected with respect to the pixel rows may be adjusted in the sensing mode.

In an embodiment, as illustrated in FIG. 2, the output control block 140A may include a first switch T1, a second switch T2, and a third switch T3. The output control block 140A may receive the sensing clock signal SCLK, a first sensing control signal SEN1, and a second sensing control signal SEN2, and may output the first scan signal SCAN[1].

The first switch T1 may include a gate electrode connected to a first node N1. The first carry signal CR[1] from the shift register 120 may be output to the first node N1 such that gate electrode of the first switch T1 may receive the first carry signal CR[1]. The first switch T1 may further include a first electrode configured to receive the sensing clock signal SCLK, and may also include a second electrode connected to the second switch T2. The first switch T1 may transmit the sensing clock signal SCLK to the second switch T2. The first switch T1 may be turned on during the active period of the first carry signal CR[1] to thereby transmit the sensing clock signal SCLK to the second switch T2.

The second switch T2 may include a gate electrode configured to receive the first sensing control signal SEN1. The second switch T2 may be connected between the first switch T1 and the output terminal OUT[1]. In an embodiment, the second switch T2 may include a first electrode connected to the second electrode of the first switch T1, and may include a second electrode connected to the output terminal OUT[1]. The second switch T2 may prevent the output terminal OUT[1] from being unexpectedly shorted with an input terminal receiving the sensing clock signal SCLK. The second switch T2 may also transmit the sensing clock signal SCLK from the first switch T1 to the output terminal OUT[1]. Here, the sensing clock signal SCLK may correspond to the first scan signal SCAN[1].

The third switch T3 may include a gate electrode configured to receive the second sensing control signal SEN2. The third switch T3 may be connected between the first node N1 and the output terminal OUT[1]. The third switch T3 may further include a first electrode connected to the first node N1, and a second electrode connected to the output terminal OUT[1]. The first carry signal CR[1] may be applied to the output terminal OUT[1] when the third switch T3 is turned on.

According to one or more embodiments, n-channel metal-oxide semiconductor (NMOS) transistors may be used as one or more of the switches T1, T2, and T3. For example, the signals applied to gate electrodes of the NMOS transistors may be activated with a logical high level. However, the inventive concept is not limited thereto, and some of the switches may be implemented with p-channel metal-oxide semiconductor (PMOS) transistors, and the signals applied to the gate electrodes of the PMOS transistors may be activated with a logical low level.

In an embodiment, the first sensing control signal SEN1 may have an inactive level (the logical low level) and the second sensing control signal SEN2 may have an active level (the logical high level) during the display mode. Thus, the second switch T2 may be turned off, and the third switch T3, may be turned on in the display mode. Contrastingly, the first sensing control signal SEN1 may have the active level (the logical high level) and the second sensing control signal SEN2 may have the inactive level (the logical low level) during the sensing mode. Thus, the second switch T2 may be turned on, and the third switch T3 may be turned off, in the sensing mode.

As described above, each of the stages ST1, ST2, ST3, etc. of the scan driver 100 may include the output control block 140 implemented by the simple circuit such that wave forms of the scan signal may be different according to the display mode and the sensing mode. Thus, a multi-sensing (or detecting) operation may be performed at each pixel row during the sensing mode such that the detection accuracy of pixel characteristics may be improved. In addition, the circuit of the output control block 140 for the pixel sensing may be separated from the shift register 120 such that malfunctions of the scan driver 100 may be detected.

Figure 3:
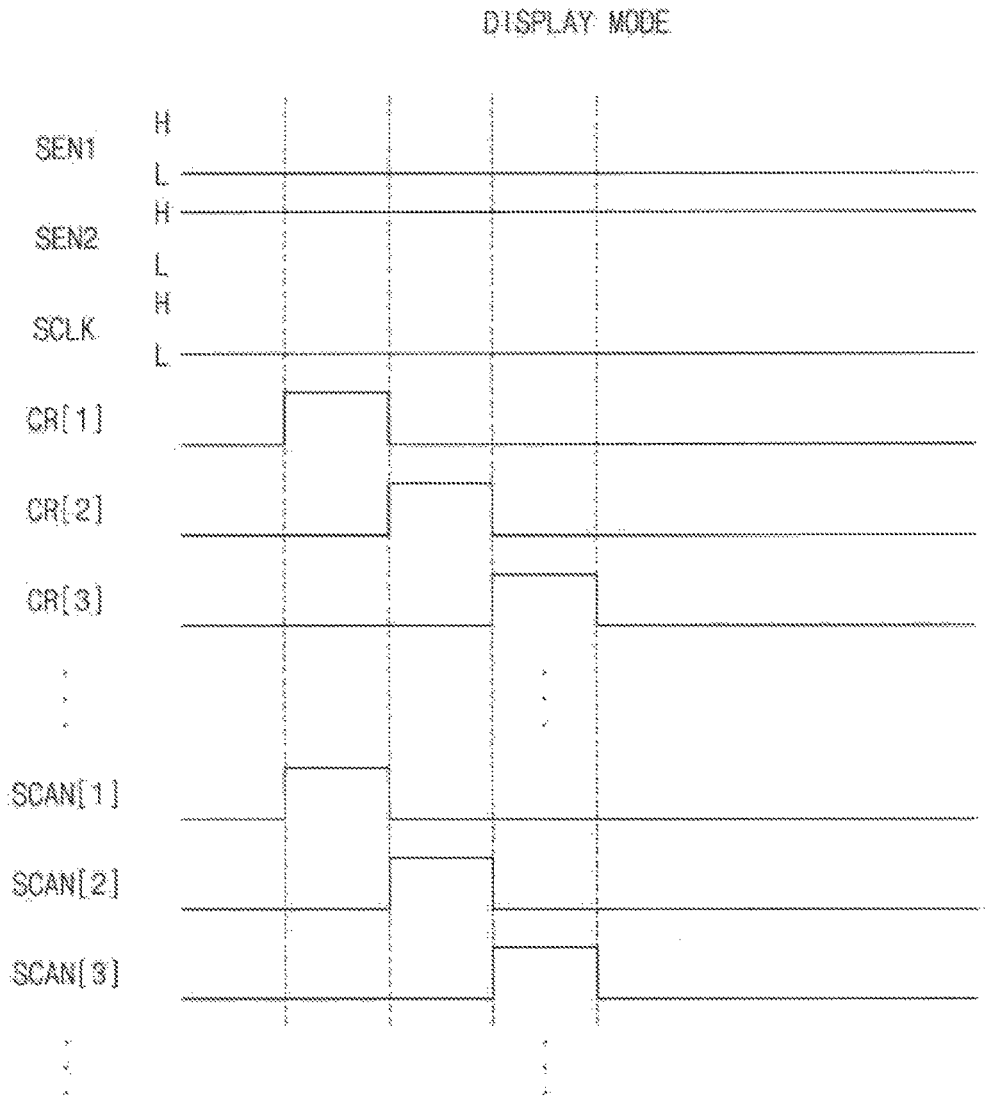
FIG. 3 is a timing diagram for an embodiment of an operation of the scan driver of FIG. 2.
Figure 4:
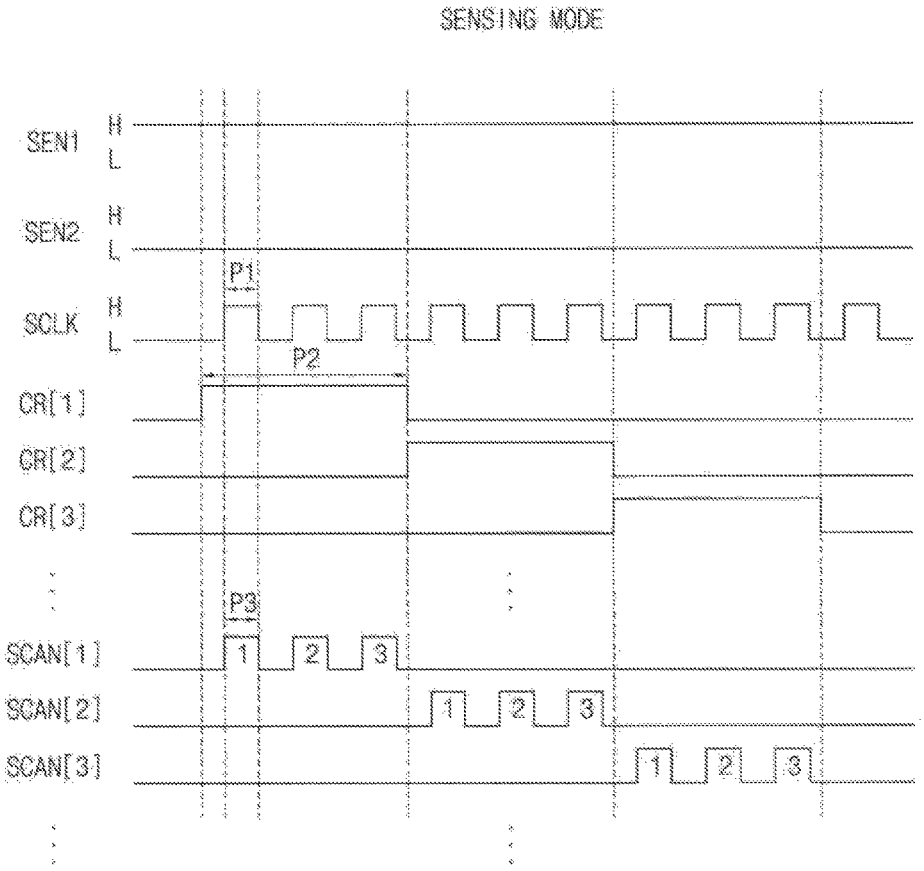
FIG. 4 is a timing diagram for another embodiment of an operation of the scan driver of FIG. 2.

FIG. 3 is a timing diagram of an operation of the scan driver of FIG. 2, and FIG. 4 is a timing diagram for another operation of the scan driver of FIG. 2.

Referring to FIGS. 2 to 4, the scan driver 100 may output different waveforms of the scan signal according to the display mode and the sensing mode.

As illustrated in FIG. 3, in the display mode, the first sensing control signal SEN1 may have the logical low level L (the inactive level), and the second sensing control signal SEN2 may have the logical high level H (the active level). The sensing clock signal SCLK may have the logical low level in the display mode. Accordingly, in the display mode, the second switch T2 of the output control block 140A may maintain a turn-off state, and the third switch of the output control block 140A may maintain a turn-on state. The second switch T2 may maintain the turn-off state such that the sensing clock signal SCLK may not be applied to the output terminal OUT[1].

The shift registers 120 of the respective stages may be connected to each other such that the carry signals CR[1], CR[2], CR[3], etc. may be sequentially output. The third switches T3 may be in the turn-on state (e.g., sequentially) such that the carry signals CR[1], CR[2], CR[3], etc. may be output as the scan signals SCAN[1], SCAN[2], SCAN[3], etc., respectively. Here, the durations of the active periods of the scan signals SCAN[1], SCAN[2], SCAN[3], etc. may be substantially the same as the durations of the active periods of the carry signals CR[1], CR[2], CR[3], etc.

As illustrated in FIG. 4, in the sensing mode, the first sensing control signal SEN1 may have the logical high level H, and the second sensing control signal SEN2 may have the logical low level L. Accordingly, in the sensing mode, the second switch T2 of the output control block 140A may maintain the turn-on state, and the third switch of the output control block 140A may maintain the turn-off state. The sensing clock signal SCLK may cyclically switch between the logical low level L and the logical high level H (e.g., with a predetermined cycle) in the sensing mode. The sensing clock signal SCLK may be provided to the all stages in common. The duration of the active period P1 of the sensing clock signal SCLK may be shorter than the duration of the active period P2 of the carry signal (e.g., CR[1], CR[2], CR[3], etc.).

The shift registers 120 connected to each other may sequentially output the carry signals CR[1], CR[2], CR[3], etc. Here, the duration of the active period P2 of the carry signals CR[1], CR[2], CR[3], etc. may be adjusted by the duration of the active period of the frame start signal FLM.

The first and second switches T1 and T2 may be turned on during the active period P2 of the first carry signal CR[1] such that the sensing clock signal SCLK may be transmitted to the output terminal OUT[1]. Thus, the duration of the single active period P3 of the first scan signal SCAN[1] may be substantially the same as the duration of the active period P1 of the sensing clock signal SCLK. Namely, the output control block 140A may generate the active periods P3 of the first scan signal SCAN[1] synchronized with the active periods P1 of the sensing clock signal SCLK in the sensing mode. The number of the active periods P1 of the sensing clock signal SCLK within the active period P2 of the first carry signal CR[1] may be the same as the number of the active periods P3 of the first scan signal SCAN[1]. As illustrated in FIG. 4, the sensing clock signal SCLK may have the active period P1 three times within the active period P2 of the first carry signal CR[1] such that the output control block 140A may output the first scan signal SCAN[1] three times (e.g., during the active periods P3). Similarly, the second to K-th stages may respectively repeatedly output the second to K-th scan signals SCAN[2], SCAN[3], etc. (e.g., three times) during the active periods P3, where K is an integer greater than 2. Thus, a display device including the scan driver 100 may perform the sensing operation (or the detecting operation) three times on each pixel row.

Accordingly, each of the stages of the scan driver 100 may include the output control block 140A implemented by the simple circuit such that wave forms of the scan signal may be different according to the display mode and the sensing mode. Thus, a multi-sensing (or detecting) operation can be performed at each pixel row during the sensing mode, such that the detection accuracy of pixel characteristics may be improved. In addition, the circuit of the output control block 140A for the pixel sensing may be separated from the shift register 120 such that malfunctions of the scan driver 100 may be detected.

Figure 5:
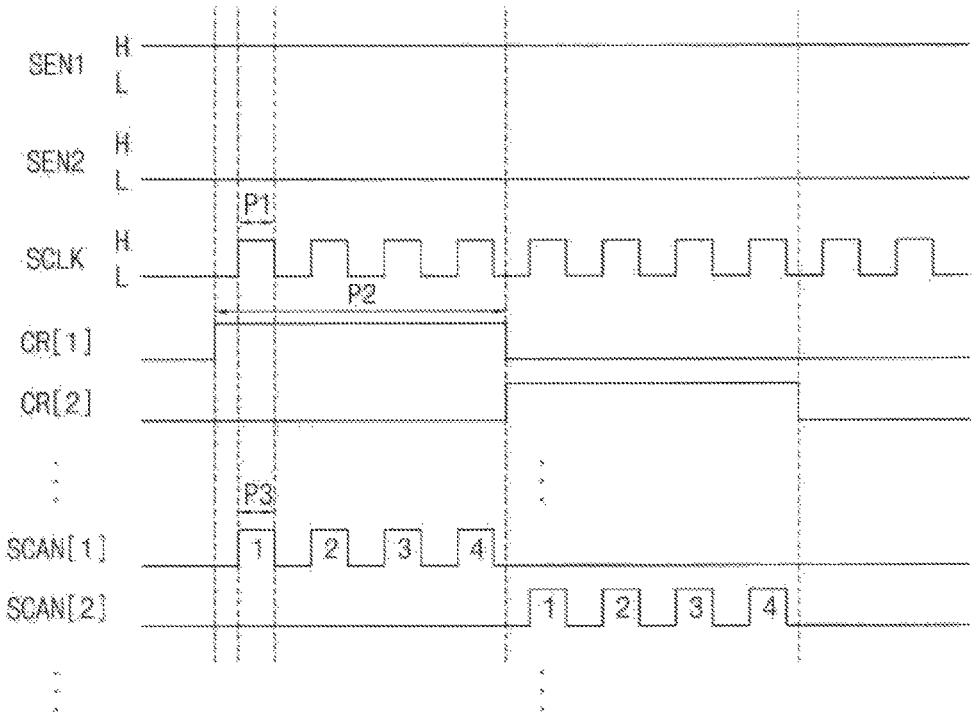
FIG. 5 is a timing diagram for still another embodiment of an operation of the scan driver of FIG. 2.
Figure 6:
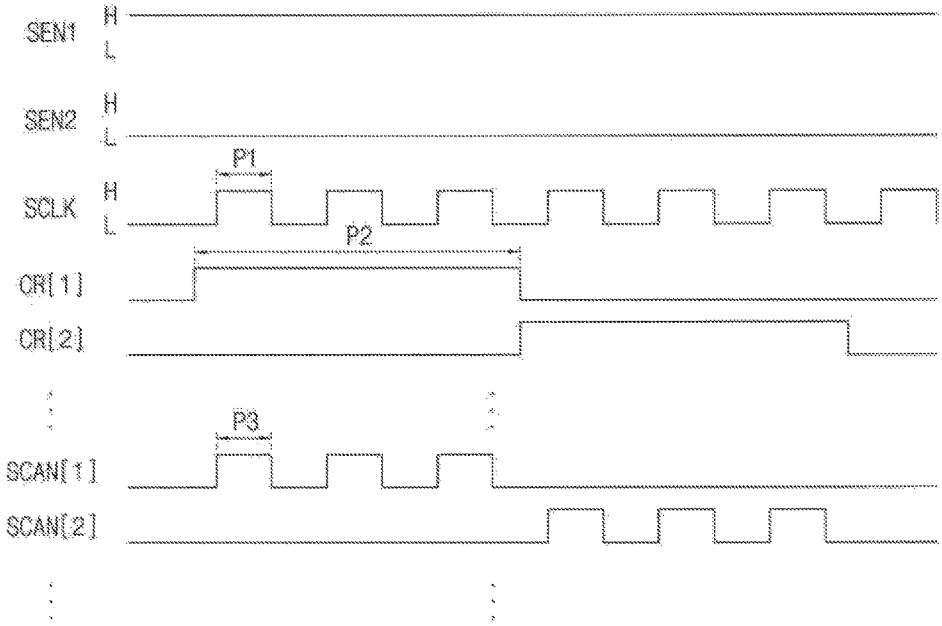
FIG. 6 is a timing diagram for further still another embodiment of an operation of the scan driver of FIG. 2.

FIG. 5 is a timing diagram for still another embodiment of an operation of the scan driver of FIG. 2, and FIG. 6 is a timing diagram for further still another embodiment of an operation of the scan driver of FIG. 2.

Referring to FIGS. 5 and 6, the scan driver 100 may determine the number of active periods P3 of scan signals SCAN[1], SCAN[2], etc. The scan driver 100 may also determine the duration of the active periods P3 of the scan signals SCAN[1], SCAN[2], etc. based on active periods P1 of a sensing clock signal SCLK and an active period P2 of carry signals CR[1], CR[2], etc. in a sensing mode.

As illustrated in FIG. 5, four active periods P1 of the sensing clock signal SCLK may be included within the active period P2 of the first carry signal CR[1]. The duration of the active period P2 of the first carry signal CR[1] may be adjusted by the cycle of clock signals CLK and CLKB applied to the shift register 120 and/or the duration of an active period of a frame start signal FLM. In an embodiment, the duration of the active period P2 of the first carry signal CR[1] may increase as the duration of the active period of the frame start signal FLM increases. Thus, the number of the active periods P3 of the first scan signal SCAN[1] may increase as the duration of the active period of the frame start signal FLM increases. For example, a first stage of the scan driver 100 may generate the active periods P3 of the first scan signal SCAN[1] four times during the active period P2 of the first carry signal CR[1]. Similarly, second to K-th stages of scan driver 100 may respectively generate the active periods P3 of second to K-th scan signals four times.

As illustrated in FIG. 6, the duration of the active period P3 of the first scan signal SCAN[1] may be adjusted by the duration of the active period P1 of the sensing clock signal SCLK. In an embodiment, the duration of the active period P3 of the first scan signal SCAN[1] may be substantially the same as the duration of the active period P1 of the sensing clock signal SCLK. Namely, the number of the active periods P3 of the scan signals SCAN[1], SCAN[2], etc. and the duration of the active periods P3 of the scan signals SCAN[1], SCAN[2], etc. may be controlled by adjusting the durations of the sensing clock signal SCLK and/or the frame start signal FLM.

However, these are examples, and the number of the active periods P3 of the scan signals SCAN[1], SCAN[2], etc., and the duration of the active periods P3 of the scan signals SCAN[1], SCAN[2], etc., are not limited thereto.

Figure 7:
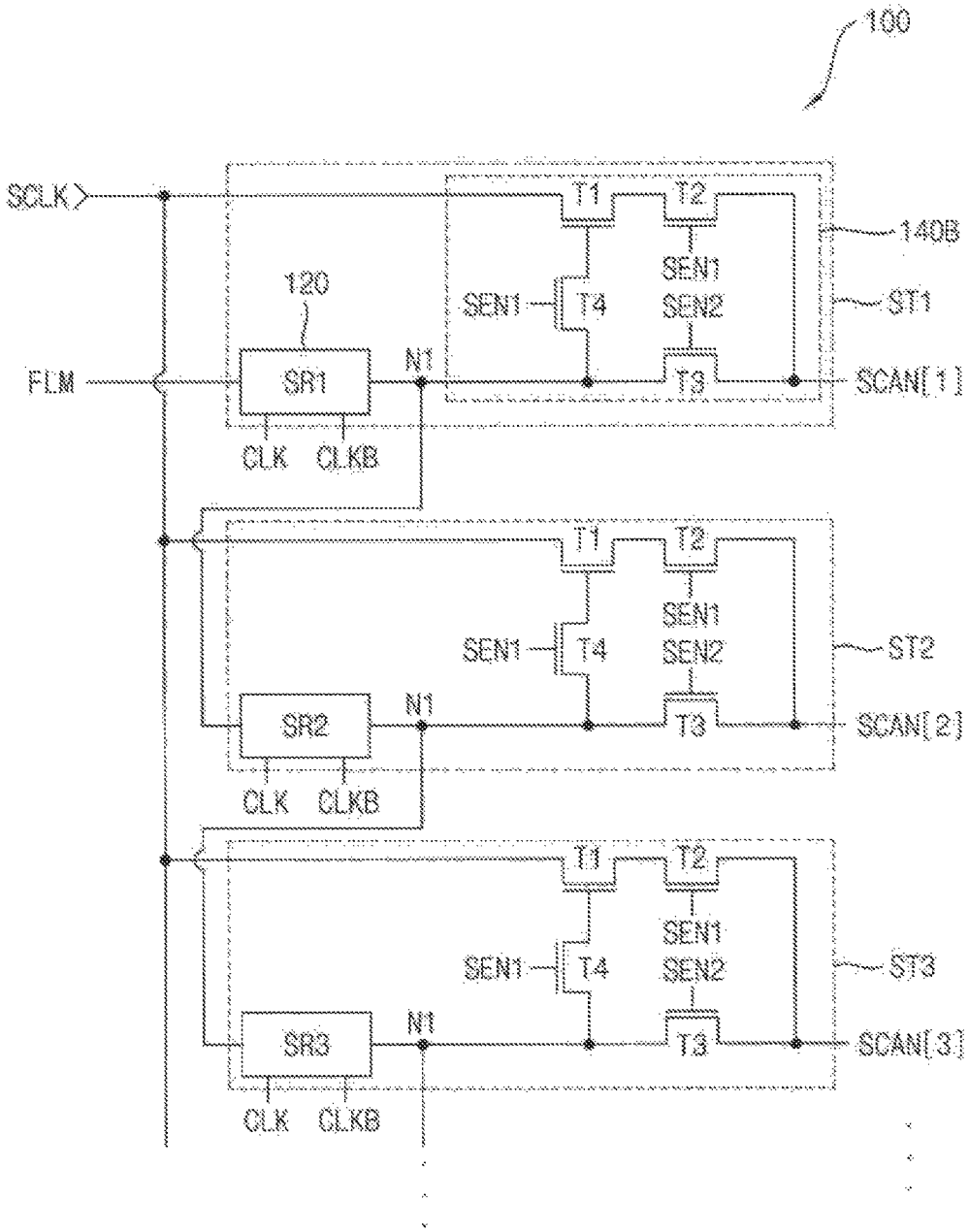
FIG. 7 is a diagram illustrating another embodiment of the scan driver of FIG. 1.

FIG. 7 is a diagram illustrating another example of the scan driver of FIG. 1.

In FIG. 7, like reference numerals are used to designate elements of the scan driver 100 that are the same as those in FIGS. 1 and 2, and detailed description of these elements may be omitted. The scan driver of FIG. 7 may be substantially the same as, or similar to, the scan driver of FIGS. 1 and 2 with the exception of the output control block 140B.

Referring to FIG. 7, the scan driver 100 may include a plurality of stages ST1, ST2, ST3, etc. connected to each other.

Each of the stages ST1, ST2, ST3, etc. may include a shift register 120 and an output control block 140B.

Hereinafter, descriptions will refer to the shift register 120 and the output control block 140B included in a first stage ST1. Constructions and operations of other stages ST2, ST3, etc. may be substantially the same as the first stage ST1.

The shift register 120 may receive the frame start signal FLM, clock signals CLK and CLKB, and a control signals, and may output a first carry signal CR[1] to the output control block 140B and to the shift register 120 of a next stage (e.g., a second stage ST2).

The output control block 140B may receive the first carry signal CR[1] from the shift register 120 and may output a first scan signal SCAN[1] to an output terminal OUT[1] based on the first carry signal CR[1]. The output control block 140B may include first to fourth switches T1 to T4. The first switch T1 may include a gate electrode configured to receive the first carry signal CR[1]. The first switch T1 may transmit the sensing clock signal SCLK based on the first carry signal CR[1]. The second switch T2 may include a gate electrode configured to receive a first sensing control signal SEN1. The second switch T2 may be connected between the first switch T1 and the output terminal OUT[1]. The third switch T3 may include a gate electrode configured to receive a second sensing control signal SEN2. The third switch T3 may be connected between a first node N1 and the output terminal OUT[1]. The fourth switch T4 may include a gate electrode configured to receive the first sensing control signal SEN1. The fourth switch T4 may be connected between the first node N1 and the gate electrode of the first switch T1. The fourth switch T4 may transmit the first carry signal CR[1] to the gate electrode of the first switch T1 based on the first sensing control signal SEN1. Because the first to third switches T1 to T3 are described above referred to FIG. 2, duplicated descriptions will not be repeated. The scan driver 100 including the output control block 140B of FIG. 7 may operate to output scan signals in a manner that is substantially the same as the operations of FIGS. 3 to 6. Accordingly, the scan driver 100 may similarly output different waveforms of the scan signal according to the display mode and the sensing mode.

Figure 8:
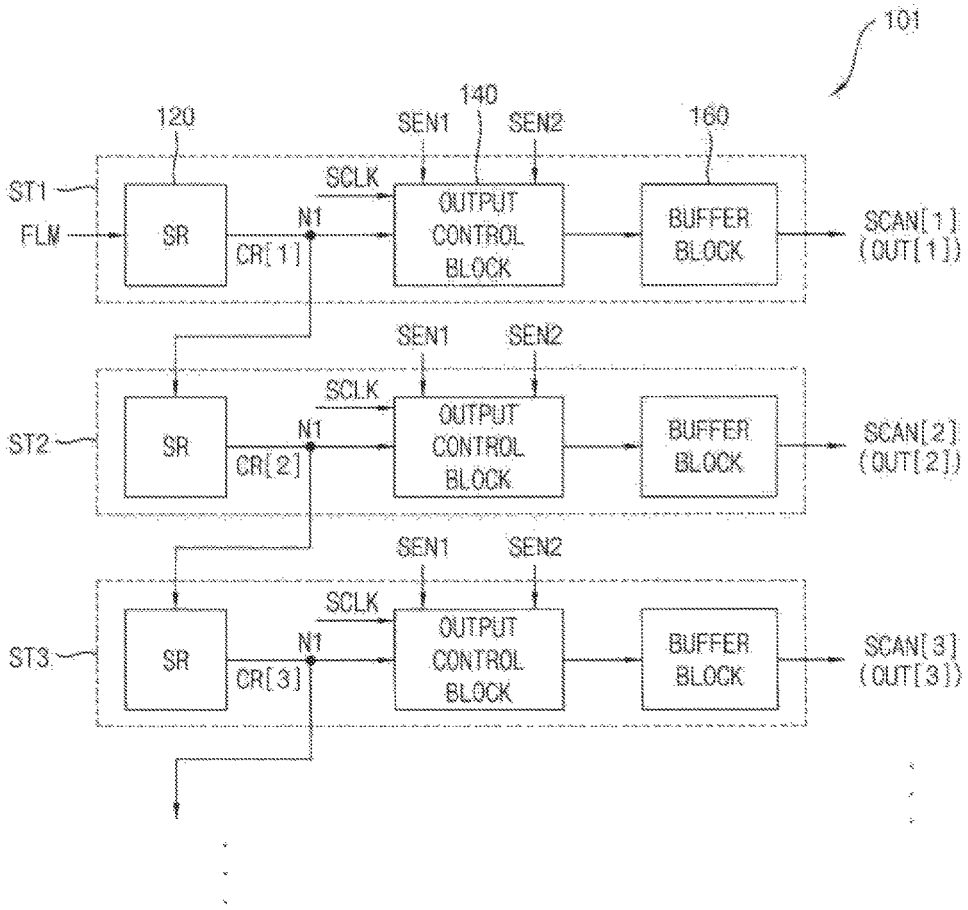
FIG. 8 is a diagram illustrating still another embodiment of the scan driver of FIG. 1.
Figure 9:
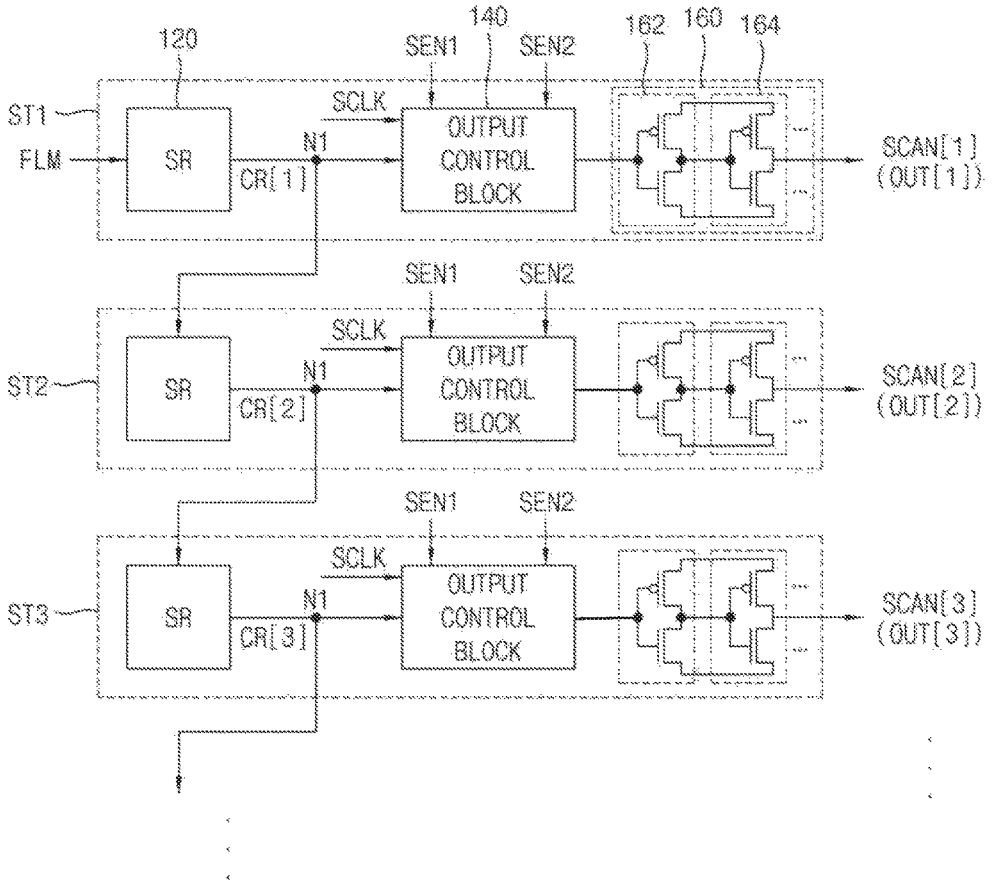
FIG. 9 is a diagram illustrating an embodiment of a buffer block included in the scan driver of FIG. 8.

FIG. 8 is a diagram illustrating still another embodiment of the scan driver of FIG. 1, and FIG. 9 is a diagram illustrating an example of a buffer block included in the scan driver of FIG. 8.

In FIGS. 8 and 9, like reference numerals are used to designate elements of the scan driver 101 that are the same as those in FIGS. 1 and 2, and detailed description of these elements may be omitted. The scan driver 101 of FIG. 8 may be substantially the same as or similar to the scan driver 100 of FIGS. 1 and 2 except for the shift register 120 and the buffer block 160.

Referring to FIGS. 8 and 9, the scan driver 101 may include a plurality of stages ST1, ST2, ST3, etc. connected to each other.

The stages ST1, ST2, ST3, etc. may be connected to corresponding scan lines. The stages ST1, ST2, ST3, etc. may output a plurality of scan signals SCAN[1], SCAN[2], SCAN[3], etc., via the scan lines, respectively.

The scan driver 101 may output the scan signals SCAN [1], SCAN[2], SCAN[3], etc. having different waveforms in accordance with a display mode and a sensing mode. In the display mode, the scan driver 101 may sequentially output the scan signals to display an image. In the sensing mode, the scan driver 101 may repeatedly output the scan signal of each scan line to detect the degree of degradation of the pixels.

Each of the stages ST1, ST2, ST3, etc. may include a shift register 120, an output control block 140, and a buffer block 160. The shift registers 120 may be connected to each other. The shift registers 120 may respectively generate carry signals CR[1], CR[2], CR[3], etc., based on a frame start signal FLM or based on the carry signal output from a previous stage.

The following description will refer to the shift register 120 and the output control block 140 included in a first stage ST1. Constructions and operations of other stages ST2, ST3, etc. may be substantially the same as the first stage ST1.

The shift register 120 may receive the frame start signal FLM, clock signals CLK and CLKB, and a control signal(s), and may output a first carry signal CR[1] to the output control block 140 and to the shift register of a next stage (e.g., a second stage ST2). In another embodiment, the buffer block 160 may be separated from the shift register 120. Namely, the shift register 120 may omit the buffer block 160. For example, the buffer block 160 may be physically connected to an output terminal of the output control block 140.

The output control block 140 may receive the first carry signal CR[1] from the shift register 120, and may output a first scan signal SCAN[1] to the buffer block 160 based on the first carry signal CR[1]. The output control block 140 may transmit the first carry signal CR[1] to the output terminal OUT[1] in the display mode. Thus, the first carry signal CR[1] may operate as the first scan signal SCAN[1]. The output control block 140 may repeatedly generate and output the first scan signal SCAN[1] during an active period of the first scan signal SCAN[1] and during the active period of the first carry signal CR[1] in the sensing mode. Namely, a plurality the first scan signal SCAN[1] may be generated during the single active period of the first carry signal CR[1] in the sensing mode. The output control block 140 may receive a sensing clock signal SCLK, and may determine the number of the active periods of the first scan signal SCAN[1] based on an active period of the sensing clock signal SCLK and based on the active period of the first carry signal CR[1] during the sensing mode. The sensing clock signal SCLK may be applied to the output control blocks 140 of all of the stages ST1, ST2, ST3, etc. in common. Because the constructions and operations of the output control block 140 are described above with reference to FIGS. 1 to 7, duplicated descriptions will not be repeated.

The buffer block 160 may control a rising time and a falling time of the first scan signal SCAN[1] that is output from the output control block 140. The buffer block 160 may control pull-up and pull-down of the first scan signal SCAN[1]. In an embodiment, as illustrated in FIG. 9, the buffer block 160 may include a plurality of complementary metal oxide semiconductor (CMOS) transistors 162 and 164 connected (e.g., connected in series) with each other. The CMOS transistor 164 may be closer to the output terminal OUT[1] than, and may be larger than, the CMOS transistor 162. Thus, the rising time and the falling time of the first scan signal SCAN[1] may be shortened. Accordingly, overlaps between the scan signals of adjacent scan lines and slacks of the scan signals may be eliminated. However, these are examples, and the construction of the buffer block 160 is not limited thereto. For example, the buffer block 160 may be comprised of NMOS transistors or PMOS transistors.

Accordingly, the buffer block 160 may be separated from the shift register 120 such that a size of the scan driver 101 may be reduced.

Figure 10:
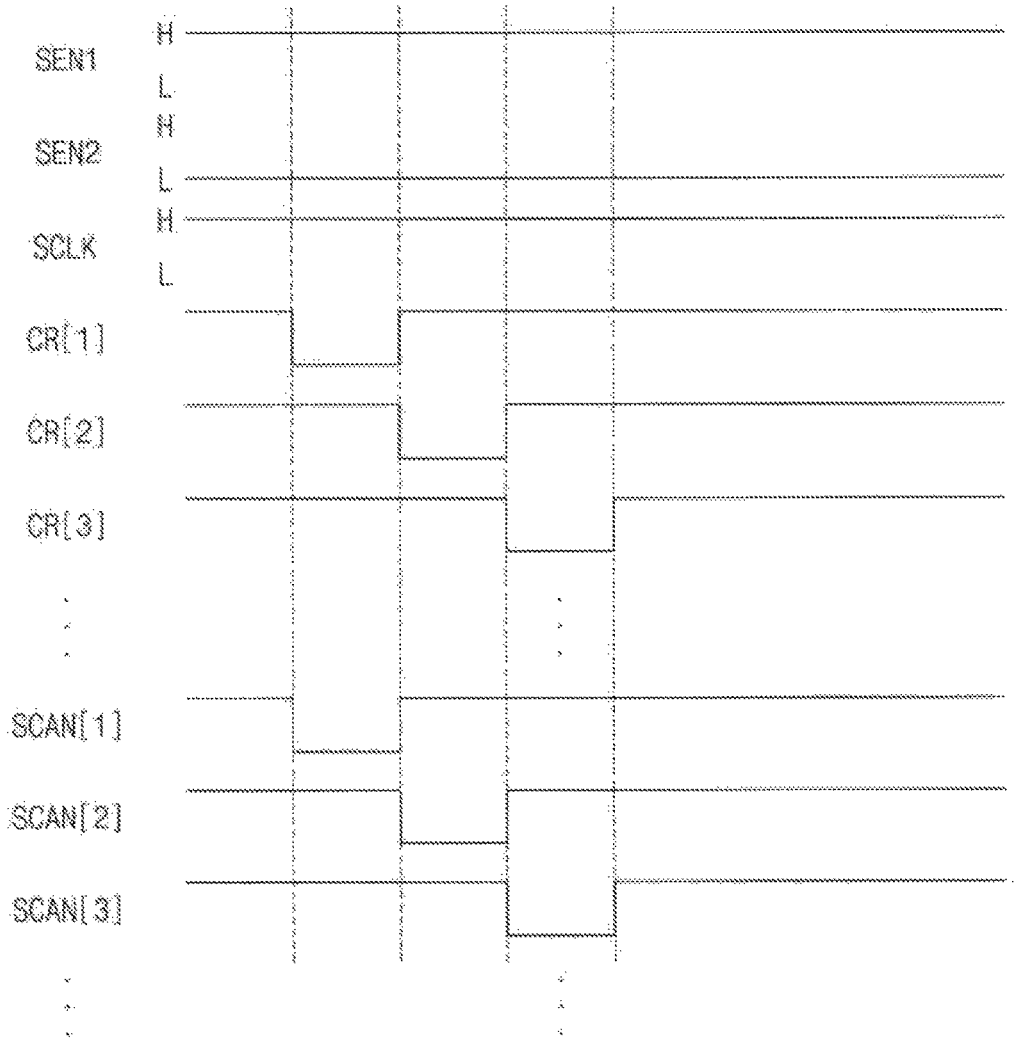
FIG. 10 is a timing diagram for an embodiment of an operation of the scan driver of FIG. 1.
Figure 11:
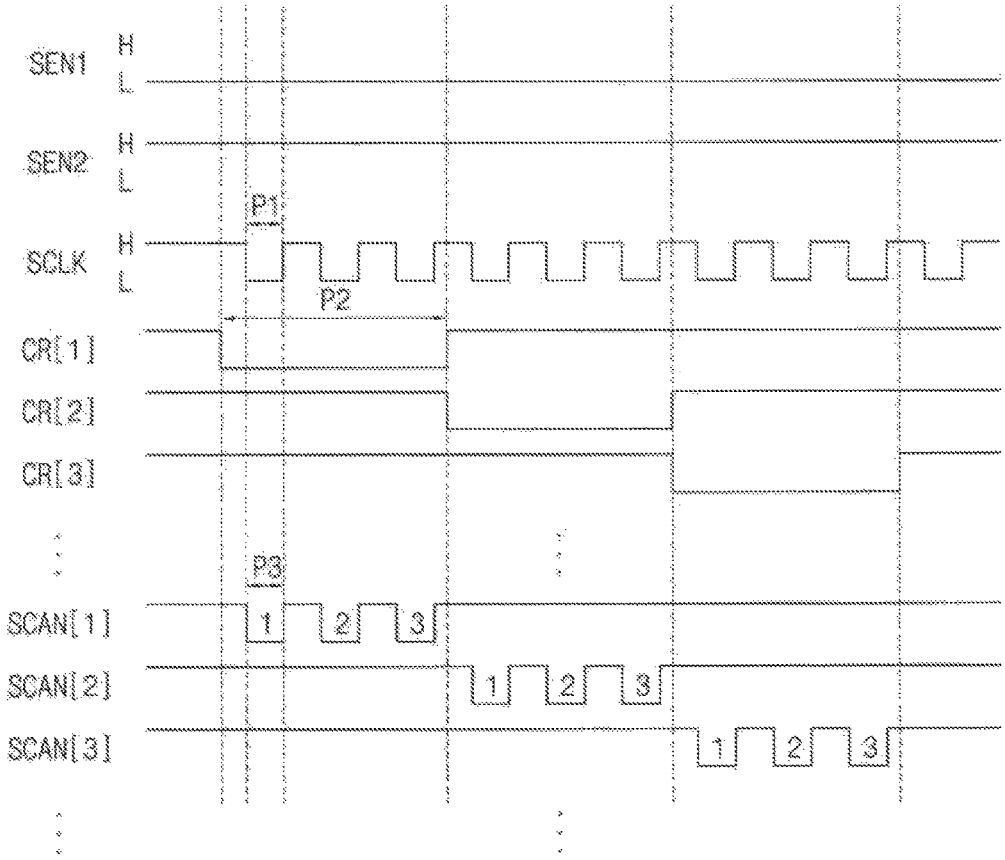
FIG. 11 is a timing diagram for an embodiment of another operation of the scan driver of FIG. 1.

FIG. 10 may be a timing diagram for an example of an operation of the scan driver of FIG. 1. FIG. 11 may be a timing diagram for an example of another operation of the scan driver of FIG. 1.

The construction and operation of the scan driver of FIGS. 10 and 11 may be substantially the same as or similar to the operations of the scan driver of FIGS. 1 to 4, except for the use of PMOS transistors (e.g., as opposed to NMOS transistors). The scan driver, and pixels connected to the scan driver, may be implemented by the PMOS transistors.

As illustrated in FIG. 10, a first sensing control signal SEN1 may have an inactive level (the logical high level H) and a second sensing control signal SEN2 may have an active level (the logical low level L) during the display mode. A sensing clock signal SCLK may have the logical high level H. Accordingly, carry signals CR[1], CR[2], CR[3], etc. may be output as scan signals SCAN[1], SCAN[2], SCAN[3], etc., respectively. Here, duration of active periods of the scan signals SCAN[1], SCAN[2], SCAN[3], etc. may be substantially the same as duration of active periods of the carry signals CR[1], CR[2], CR[3], etc.

As illustrated in FIG. 11, the first sensing control signal SEN1 may have the active level (the logical low level L), and the second sensing control signal SEN2 may have the inactive level (the logical high level H), during the sensing mode. The sensing clock signal SCLK may repeatedly switch between the logical low level L and the logical high level H with a cycle (e.g., predetermined cycle) in the sensing mode. The number of the active periods P3 of the first scan signal SCAN[1] may be the same as the number of active periods P1 of the sensing clock signal SCLK within the active period P2 of the first carry signal CR[1]. Similarly, the second to K-th stages may repeatedly output the active periods P3 of the second to K-th scan signals SCAN[2], SCAN[3], etc., respectively, where K is an integer that is greater than 2.

Figure 12:
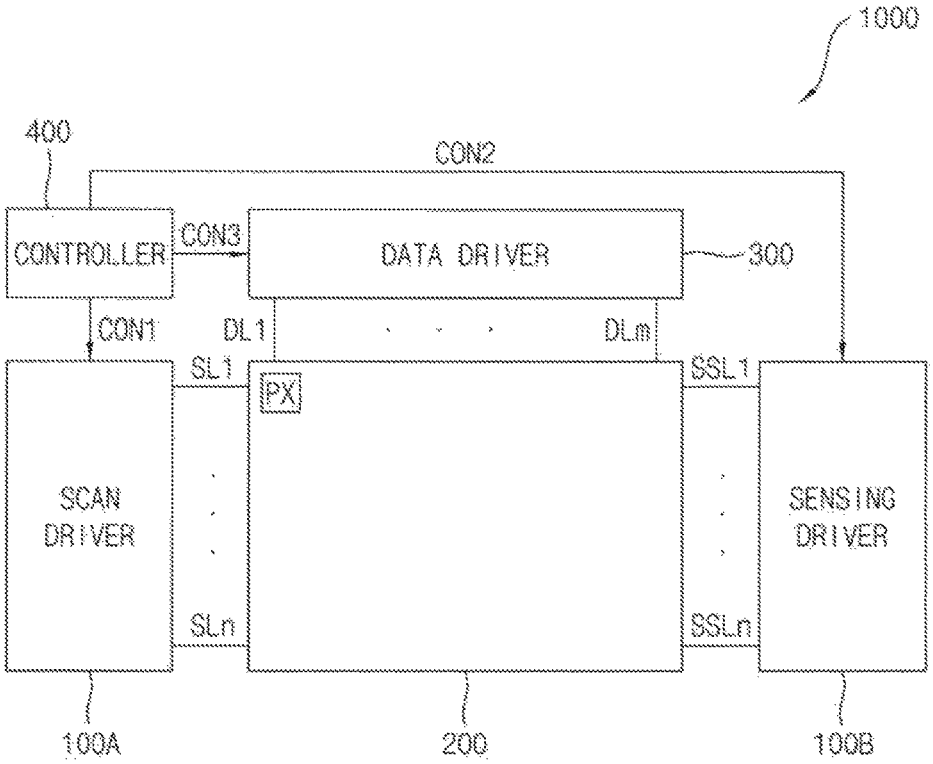
FIG. 12 is a block diagram of an organic light emitting display device according to an embodiment.

FIG. 12 is a block diagram of an organic light emitting display device according to an embodiment.

Referring to FIG. 12, the organic light emitting display device 1000 may include a scan driver 100A, a sensing driver 1008, a display panel 200, a data driver 300, and a controller 400. In an embodiment, the organic light emitting display device 1000 may further include an emission driver for generating emission control signals to control emission of a plurality of pixels PX.

The organic light emitting display device 1000 may be driven by a display mode and by a sensing mode. The display panel 200 may display images in the display mode. An external compensation with respect to the pixels PX for compensating degradation of the pixels PX may be performed in the sensing mode. For example, variations of threshold voltages of a driving transistor of the pixels PX, variations of mobility the driving transistor, and degradations of the pixels PX may be detected in the sensing mode. In an embodiment, the sensing mode may be activated during a time (e.g., a predetermined time) when the display panel 200 is turned on and/or turned off. In an embodiment, the sensing mode may be periodically activated.

The display panel 200 may display images. The display panel 200 may include a plurality of scan lines SL1 through SLn, a plurality of sensing lines SSL1 through SSLn, and a plurality of data lines DL1 through DLm. The display panel 200 may also include the pixels PX connected to the scan lines SL1 through SLn, the sensing lines SSL1 through SSLn, and the data lines DL1 through DLm. For example, the pixels PX may be arranged in a matrix form. In some embodiments, the number of pixels PX may be equal to n×m, where n and m are integers greater than 0.

The scan driver 100A may provide a plurality of scan signals to the display panel 200. In an embodiment, the scan driver 100A may output the plurality of scan signals to the scan lines SL1 through SLn. The scan driver 100A may output the scan signals based on a first control signal CON1 received from the controller 400. The scan driver 100A may include a plurality of stages ST1, ST2, ST3, etc. for respectively outputting the scan signals. The scan driver 100A may sequentially provide the scan signals to the display panel 200 in the display mode. The scan driver 100A may repeatedly generate an active period of each of the scan signals in the sensing mode.

In an embodiment, an N-th stage of the scan driver 100A may include a shift register 120 configured to output an N-th carry signal (e.g., N-the carry signal CR[N]) based on a frame start signal or a carry signal from a previous stage, and may also include an output control block 140 configured to output the N-th carry signal as an N-th scan signal in the display mode, and configured to repeatedly output active periods of the N-th scan signal during an active period of the N-th carry signal in the sensing mode, where N is a positive integer.

The N-th stage of the scan driver 100A may include an output control block 140, which may receive a sensing clock signal during the sensing mode, and may determine the number of active periods of the N-th scan signal in the sensing mode based on an active period of the sensing clock signal and based on the active period of the N-th carry signal. In an embodiment, the output control block 140 may include first to third transistors. The first transistor may include a gate electrode connected to a first node N1 to receive the N-th carry signal. The first switch may transmit the sensing clock signal based on the N-th carry signal. The second transistor may include a gate electrode to receive a first sensing control signal. The second switch may be connected between the first switch and an output terminal. The third transistor may include a gate electrode to receive a second sensing control signal. The third switch may be connected between the first node N1 and the output terminal OUT[1].

Accordingly, and for example, the scan driver 100A may correspond to one of the scan drivers 100 of FIGS. 1 to 7. Thus, a multi-sensing (or detecting) operation may be performed at each pixel row corresponding to each of the scan lines SL1 through SLn in the sensing mode.

The sensing driver 100B may provide a plurality of sensing signals to the display panel 200. In an embodiment, the sensing driver 1006 may output the plurality of sensing signals to the sensing lines SSL1 through SSLn. The sensing driver 100B may output the sensing signals based on a second control signal CON2 received from the controller 400. The sensing driver 1006 may include a plurality of stages ST1, ST2, ST3, etc. for respectively outputting the sensing signals. Here, each of the sensing signals may correspond to a signal for controlling a sensing transistor included in each of the pixels PX. The sensing driver 1006 may repeatedly generate an active period of each of the sensing signals in the sensing mode. The sensing driver 1006 may not generate the active period of the sensing signals in the display mode. In an embodiment, the construction and operation of the sensing driver 1006 may be substantially the same as, or similar to, that of the scan driver 100A. Thus, the multi-sensing (or detecting) operations may be performed at each pixel row corresponding to each of the scan lines SL1 through SLn (and corresponding sensing lines SSL1 through SSLn) in the sensing mode.

The data driver 300 may convert a data signal received from the controller 400 into a data voltage (e.g., an analog data voltage) based on a third control signal CON3 received from the controller 400. The data driver 300 may output the data voltage to the data lines DL1 through DLm. In the display mode, the data driver 300 may provide the data voltage corresponding to a display image to the display panel 200. In the sensing mode, the data driver 300 may provide a sensing voltage to the display panel 200 based on the data control signal.

The controller 400 may control the scan driver 100A, the sensing driver 1008, and the data driver 300. The controller 400 may receive an input control signal and an input image signal from an image source, such as an external graphic apparatus. The controller 400 may generate the data signal (e.g., a digital data signal) corresponding to operating conditions of the display panel 200 based on the input image signal. In addition, the controller 400 may generate the first control signal CON1 for controlling a driving timing of the scan driver 100A, may generate the second control signal CON2 for controlling a driving timing of the sensing driver 1008, and may generate the third control signal CON3 for controlling a driving timing of the data driver 300, based on the input control signal. The controller 400 may output the first to third control signals CON1, CON2, and CON3 to the scan driver 100A, the sensing driver 1008, and the data driver 300, respectively.

The controller 400 may perform compensation with respect to the pixels PX based on sensing currents that are repeatedly generated at the pixels corresponding to (e.g., connected to) the scan line in the sensing mode. In an embodiment, the controller 400 may calculate sensing values of the pixels PX based on the sensing currents, and may compensate the input images data based on the sensing values. In an embodiment, the controller 400 may calculate a compensation value of the input image data based on at least one of an average of the sensing currents, a maximum value of the sensing currents, and a minimum value of the sensing currents in the sensing mode. Thus, exact compensation values based on the sensing currents may be obtained.

As described above, the organic light emitting display device 1000 may perform the multi-sensing at each pixel row corresponding to each of the scan lines SL1 through SLn in the sensing mode. The organic light emitting display device 1000 may also calculate more accurate sensing values or compensation values based on statistics of the multi-sensing results. Thus, accuracy of compensation of pixel characteristics and degradations may be improved, and the image quality of the organic light emitting display device 1000 may be improved.

Figure 13:
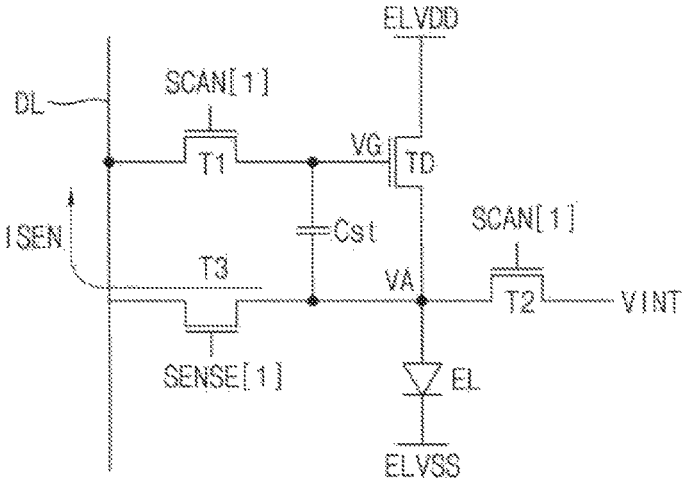
FIG. 13 is a diagram illustrating an embodiment of a pixel included in the organic light emitting display device of FIG. 12.

FIG. 13 is a diagram illustrating an example of a pixel included in the organic light emitting display device of FIG. 12.

Referring to FIG. 13, each of the pixels PX may include an organic light emitting diode EL, a scan transistor T1, a storage capacitor Cst, a driving transistor TD, an initialization transistor T2, and a sensing transistor T3. It should be noted that the scan transistor T1, the initialization transistor T2, and the sensing transistor T3 are different than the first to third switches T1, T2, and T3 described above.

The scan transistor T1 may be connected between a data line DL and a gate electrode of the driving transistor TD. The scan transistor T1 may transmit a sensing voltage VG to the gate electrode of the driving transistor TD in response to a scan signal SCAN[1] in the sensing mode. In one embodiment, the sensing voltage VG may be provided to the gate electrode of the driving transistor TD through the data line DL in the sensing mode to detect pixel characteristics.

The storage capacitor Cst may be connected between the gate electrode of the driving transistor TD and a source electrode of the driving transistor TD. When the scan transistor T1 is turned on, the storage capacitor Cst may store a voltage difference between the sensing voltage VG and a voltage VA of the source electrode of the driving transistor TD.

The driving transistor TD may be connected to a first power voltage ELVDD.

The driving transistor TD may generate a sensing current ISEN corresponding to a charged voltage at the storage capacitor Cst based on the sensing voltage VG.

The initialization transistor T2 may provide an initialization voltage VINT to the source electrode of the driving transistor TD (i.e., to an anode of the organic light emitting diode EL) in response to the scan signal SCAN[1]. The initialization voltage VINT may be, for example, a ground voltage.

The sensing transistor T3 may be connected between the data line DL and the source electrode of the driving transistor TD. The sensing transistor T3 may transmit the sensing current ISEN to the data line DL in response to a sensing signal SENSE[1] in the sensing mode.

Here, the scan signal SCAN[1] and the sensing signal SENSE[1] may have a plurality of active periods. The number of the scan signal SCAN[1] may be the same as the number of the sensing signal SENSE[1]. Thus, the multi-sensing operation with respect to the pixel may be performed in the sensing mode.

The controller 400 may receive the sensing current ISEN, and may perform the compensation operation based on the sensing current ISEN.

Figure 14:
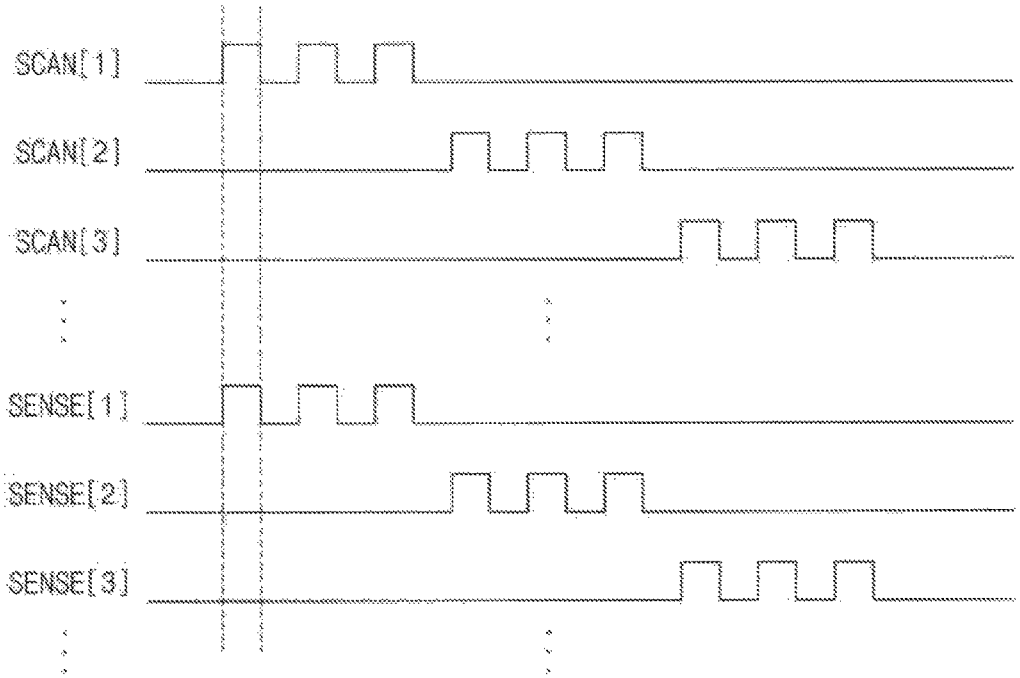
FIG. 14 is a timing diagram for an embodiment of an operation of the organic light emitting display device of FIG. 12.
Figure 15:
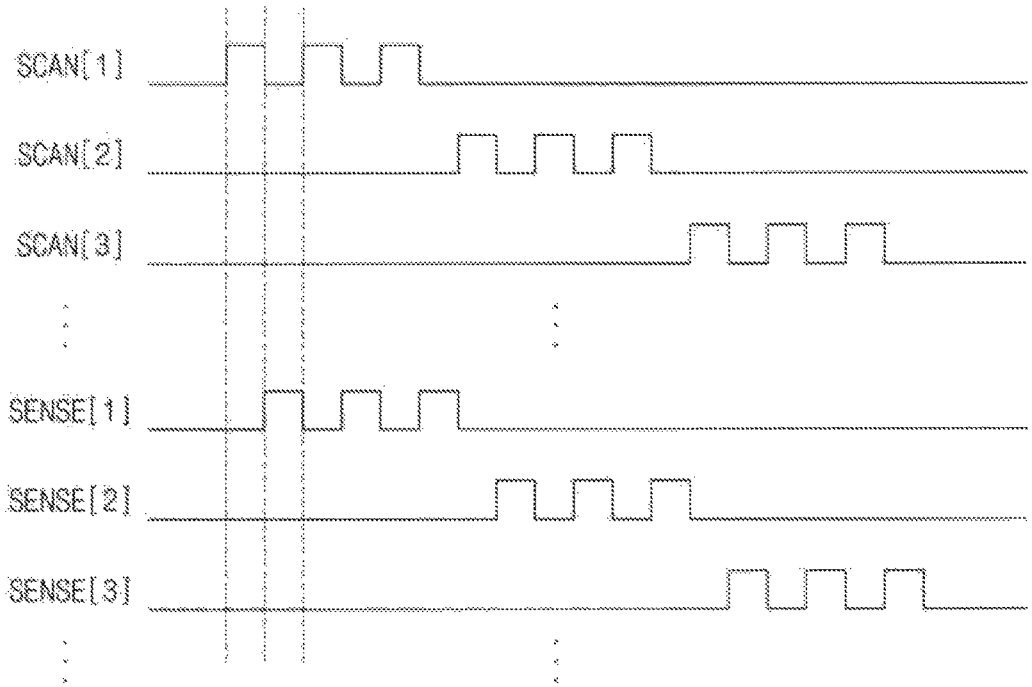
FIG. 15 is a timing diagram for another embodiment of an operation of the organic light emitting display device of FIG. 12.

FIG. 14 is a timing diagram for an example of an operation of the organic light emitting display device of FIG. 12, and FIG. 15 is a timing diagram for another example of an operation of the organic light emitting display device of FIG. 12.

Referring to FIGS. 12, 14, and 15, the scan driver 100A and the sensing driver 1008 may respectively provide a plurality of scan signals SCAN[1], SCAN[2], SCAN[3], etc. and a plurality of sensing signals SENSE[1], SENSE[2], SENSE[3], etc. to the display panel 200 in the sensing mode.

An active period of each scan signal may be repeatedly output to the corresponding scan line and an active period of each sensing signal may be repeatedly output to the corresponding sensing line in the sensing mode. Thus, the multi-sensing operation with respect to each corresponding pixel row may be performed in the sensing mode.

In one embodiment, as illustrated in FIG. 14, the active periods of the scan signal and the active periods of the sensing signal may be concurrently provided to the corresponding pixel row. For example, a data writing operation and a sensing operation may be concurrently performed. Alternatively, in one embodiment, as illustrated in FIG. 15, the scan signal may be provided, and then the sensing signal may be provided thereafter. For example, the data writing operation may be performed and then the sensing operation may be performed. However, these are examples, and the timings of the active periods of the scan and sensing signals are not limited thereto.

Figure 16:
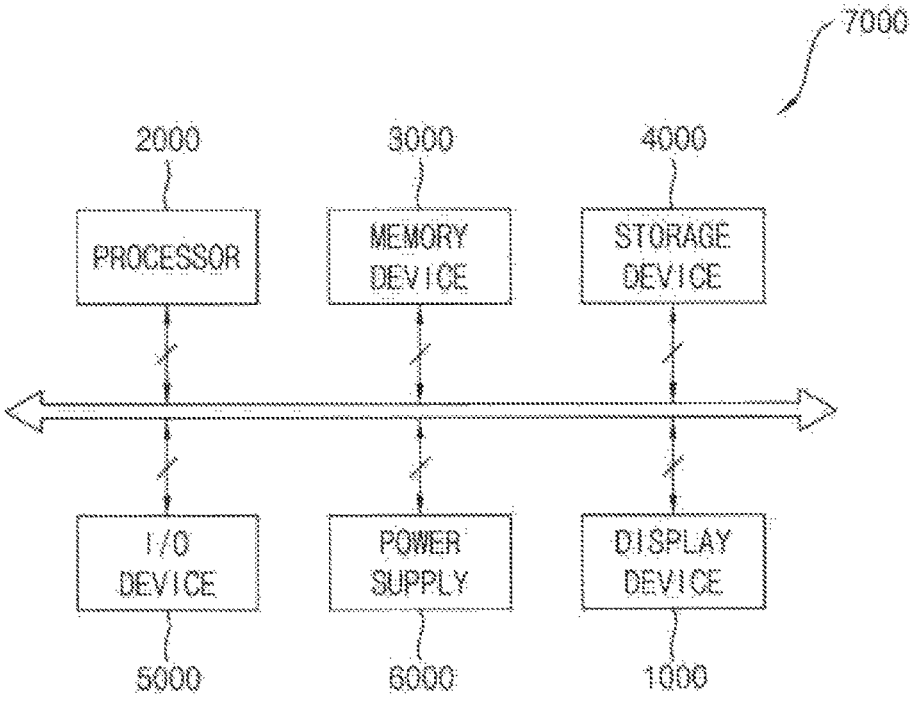
FIG. 16 is a block diagram of an electronic device according to embodiments.
Figure 17A:
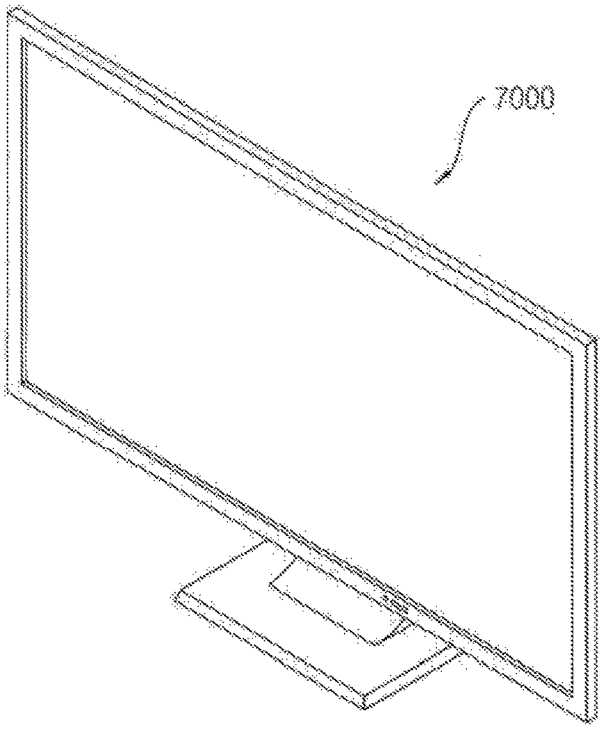
FIG. 17A is a diagram illustrating an embodiment of the electronic device implemented as a television.
Figure 17B:
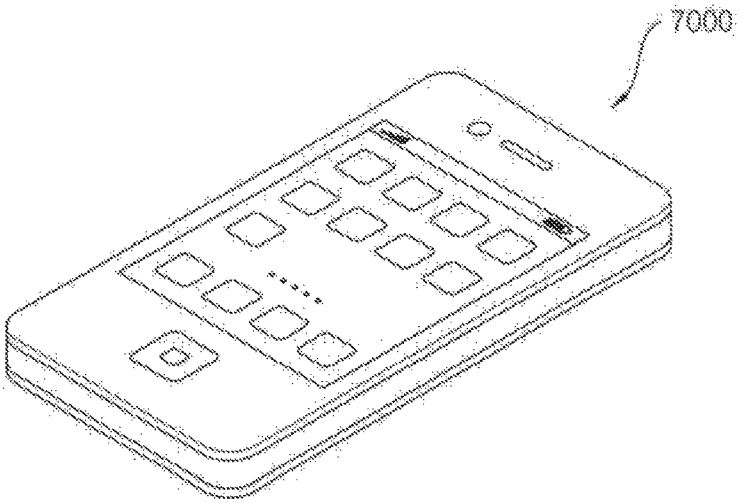
FIG. 17B is a diagram illustrating an embodiment of the electronic device implemented as a smart phone.

FIG. 16 is a block diagram of an electronic device according to an embodiment, FIG. 17A is a diagram illustrating an embodiment of the electronic device implemented as a television, and FIG. 17B is a diagram illustrating an embodiment of the electronic device implemented as a smart phone.

Referring to FIGS. 16 to 17B, the electronic device 7000 may include an organic light emitting display device 1000, a processor 2000, a memory device 3000, a storage device 4000, an input/output (I/O) device 5000, and a power supply 6000. Here, the organic light emitting display device 1000 may correspond to the organic light emitting display device of FIG. 12. In addition, the electronic device 7000 may further include a plurality of ports for communicating with a video card, a sound card, a memory card, a universal serial bus (USB) device, or other suitable electronic devices, etc. In one embodiment, as illustrated in FIG. 17A, the electronic device 7000 may be implemented in a television. In one embodiment, as illustrated in FIG. 17B, the electronic device 7000 may be implemented in a smart phone. However, these are examples and the electronic device 7000 is not limited thereto. For example, the electronic device 7000 may be implemented in a cellular phone, a video phone, a smart pad, a smart watch, a tablet, a personal computer, a navigation for vehicle, a monitor, a notebook, a head mounted display (HMD), and/or the like.

The processor 2000 may perform various suitable computing functions. The processor 2000 may be a microprocessor, a central processing unit (CPU), etc. The processor 2000 may be coupled to other suitable components via an address bus, a control bus, a data bus, etc. Furthermore, the processor 2000 may be coupled to an extended bus such as a peripheral component interconnection (PCI) bus.

The memory device 3000 may also store data for operations of the electronic device 7000. For example, the memory device 3000 may include at least one non-volatile memory device, such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device, such as a dynamic random access memory (DRAM) device, a static random access memory (SRAM) device, a mobile DRAM device, and/or the like.

The storage device 4000 may store data for operations of the electronic device 7000. The storage device 4000 may be a solid state drive (SSD) device, a hard disk drive (HDD) device, a CD-ROM device, and/or the like.

The I/O device 5000 may be an input device, such as a keyboard, a keypad, a touchpad, a touch-screen, a mouse, and/or the like, and an output device, such as a printer, a speaker, and/or the like.

The power supply 6000 may provide power for operating the electronic device 1000.

The organic light emitting display device 1000 may be connected to other elements via the buses or other communication links. According to an embodiment, the organic light emitting display device 1000 may be included in the I/O device 5000. As described above, the organic light emitting display device 1000 may include a display panel 200 comprising a plurality of pixels PX configured to be driven by a display mode and by a sensing mode, a data driver 300 configured to provide a data voltage corresponding to a display image to the display panel 200 in the display mode and configured to provide a sensing voltage VG to the display panel 200 based on a data control signal in the sensing mode, a scan driver 100A configured to repeatedly generate an active period of a scan signal applied to a scan line in the sensing mode, a sensing driver 1006 configured to repeatedly generate an active period of a sensing signal applied to a sensing line corresponding to the scan line in the sensing mode, and a controller 400 configured to perform a compensation with respect to the pixels PX based on sensing currents that are repeatedly generated at the pixels corresponding to (e.g., connected to) the scan line in the sensing mode.

As described above, the organic light emitting display device 1000 may perform a multi-sensing at each pixel row corresponding to each of scan lines in the sensing mode. The organic light emitting display device 1000 may also calculate more accurate sensing values or compensation values based on statistics of the multi-sensing results. Thus, accuracy of compensation of pixel characteristics and degradations may be improved and the image quality of the organic light emitting display device 1000 may be improved.

The present embodiments may be applied to any display device and any system including the display device. For example, the present embodiments may be applied to a television (TV), a digital TV, a 3D TV, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A scan driver comprising a plurality of stages for respectively outputting a plurality of scan signals, an N-th stage of the stages comprising:

a shift register for outputting an N-th carry signal based on a frame start signal or based on a carry signal from a previous stage; and an output control block for outputting the N-th carry signal as an N-th scan signal in a display mode, and for repeatedly outputting active periods of the N-th scan signal during an active period of the N-th carry signal in a sensing mode, wherein N is a positive integer.

2. The scan driver of claim 1, wherein the output control block is for receiving a sensing clock signal and for determining a number of active periods of the N-th scan signal in the sensing mode based on an active period of the sensing clock signal and based on the active period of the N-th carry signal.

3. The scan driver of claim 2, wherein a duration of the active period of the N-th scan signal is substantially the same as a duration of the active period of the sensing clock signal.

4. The scan driver of claim 3, wherein the output control block is for generating the active period of the N-th scan signal that is synchronized with the active period of the sensing clock signal during the sensing mode.

5. The scan driver of claim 2, wherein the output control block comprises:

a first switch for transmitting the sensing clock signal based on the N-th carry signal and comprising a gate electrode connected to a first node to receive the N-th carry signal;

a second switch connected between the first switch and an output terminal, and comprising a gate electrode for receiving a first sensing control signal; and a third switch connected between the first node and the output terminal, and comprising a gate electrode for receiving a second sensing control signal.

6. The scan driver of claim 5, wherein the first sensing control signal has an inactive level during the display mode, and wherein the second sensing control signal has an active level during the display mode.

7. The scan driver of claim 5, wherein the first sensing control signal has an active level during the sensing mode, and wherein the second sensing control signal has an inactive level during the sensing mode.

8. The scan driver of claim 2, wherein the output control block comprises:

a first switch for transmitting the sensing clock signal based on the N-th carry signal, and comprising a gate electrode for receiving the N-th carry signal;

a second switch connected between the first switch and an output terminal, and comprising a gate electrode for receiving a first sensing control signal;

a third switch connected between the output terminal and a first node where the N-th carry signal is output, and comprising a gate electrode for receiving a second sensing control signal; and a fourth switch connected between the first node and the gate electrode of the first switch, and comprising a gate electrode for receiving the first sensing control signal.

9. The scan driver of claim 8, wherein the first sensing control signal has an inactive level during the display mode, and wherein the second sensing control signal has an active level during the display mode.

10. The scan driver of claim 8, wherein the first sensing control signal has an active level during the sensing mode, and wherein the second sensing control signal has an inactive level during the sensing mode.

11. An organic light emitting display device comprising:

a display panel comprising a plurality of pixels to be driven by a display mode and by a sensing mode;

a data driver for providing a data voltage corresponding to a display image to the display panel in the display mode, and for providing a sensing voltage to the display panel based on a data control signal in the sensing mode;

a scan driver for repeatedly generating and applying an active period of a scan signal to a scan line in the sensing mode;

a sensing driver for repeatedly generating and applying an active period of a sensing signal to a sensing line corresponding to the scan line in the sensing mode; and a controller for performing a compensation with respect to the pixels based on sensing currents that are repeatedly generated at the pixels corresponding to the scan line in the sensing mode.

12. The device of claim 11, wherein the controller is for calculating a compensation value of image data based on at least one of an average of the sensing currents, a maximum value of the sensing currents, and a minimum value of the sensing currents in the sensing mode.

13. The device of claim 11, wherein the scan driver comprises a plurality of stages for respectively outputting a plurality of scan signals, an N-th stage of the stages comprising:

a shift register for outputting an N-th carry signal based on a frame start signal or based on a carry signal from a previous stage; and an output control block for outputting the N-th carry signal as an N-th scan signal in the display mode, and for repeatedly outputting active periods of the N-th scan signal during an active period of the N-th carry signal in the sensing mode, wherein N is a positive integer.

14. The device of claim 13, wherein the output control block is for receiving a sensing clock signal during the sensing mode, and for determining a number of active periods of the N-th scan signal in the sensing mode based on an active period of the sensing clock signal and based the active period of the N-th carry signal.

15. The device of claim 14, wherein a duration of the active period of the N-th scan signal is substantially the same as a duration of the active period of the sensing clock signal.

16. The device of claim 14, wherein the output control block comprises:

a first switch for transmitting the sensing clock signal based on the N-th carry signal, and comprising a gate electrode connected to a first node for receiving the N-th carry signal;

a second switch connected between the first switch and an output terminal, and comprising a gate electrode for receiving a first sensing control signal; and a third switch connected between the first node and the output terminal, and comprising a gate electrode for receiving a second sensing control signal.

17. The device of claim 11, wherein the sensing driver comprises a plurality of stages for respectively outputting a plurality of sensing signals, an N-th stage of the stages comprising:

a shift register for outputting an N-th carry signal based on a frame start signal or based on a carry signal from a previous stage; and an output control block for outputting the N-th carry signal as an N-th sensing signal in the display mode, and for repeatedly outputting active periods of the N-th sensing signal during an active period of the N-th carry signal in the sensing mode, wherein N is a positive integer.

18. A scan driver comprising a plurality of stages for respectively outputting a plurality of scan signals, an N-th stage of the stages comprising:

a shift register for outputting an N-th carry signal based on a frame start signal or based on a carry signal from a previous stage;

an output control block for outputting the N-th carry signal as an N-th scan signal in a display mode, and for repeatedly outputting active periods of the N-th scan signal during an active period of the N-th carry signal in a sensing mode; and a buffer block for controlling a rising time and a falling time of the N-th scan signal output from the output control block, wherein N is a positive integer.

19. The scan driver of claim 18, wherein the output control block is for receiving a sensing clock signal during the sensing mode, and for determining a number of active periods of the N-th scan signal in the sensing mode based on an active period of the sensing clock signal and based on the active period of the N-th carry signal.

20. The scan driver of claim 19, wherein the buffer block comprises a plurality of complementary metal oxide semiconductor (CMOS) transistors connected in series to each other.

* * * * *